US009719740B2

(12) United States Patent
Rowe et al.

(10) Patent No.: US 9,719,740 B2
(45) Date of Patent: Aug. 1, 2017

(54) MINIGUN WITH IMPROVED FEEDER SPROCKET AND SHAFT

(71) Applicant: PROFENSE, LLC, Phoenix, AZ (US)

(72) Inventors: Thomas Rowe, Phoenix, AZ (US); Arthur O'Donnell, Gilbert, AZ (US)

(73) Assignee: Profense, LLC, Phoenix, AZ (US)

( * ) Notice: Subject to any disclaimer, the term of this patent is extended or adjusted under 35 U.S.C. 154(b) by 0 days.

(21) Appl. No.: 14/893,174

(22) PCT Filed: Jun. 3, 2014

(86) PCT No.: PCT/US2014/040709

§ 371 (c)(1),
(2) Date: Nov. 23, 2015

(87) PCT Pub. No.: WO2015/026419

PCT Pub. Date: Feb. 26, 2015

(65) Prior Publication Data

US 2016/0123686 A1 May 5, 2016

Related U.S. Application Data

(60) Provisional application No. 61/830,551, filed on Jun. 3, 2013, provisional application No. 61/830,568, filed on Jun. 3, 2013.

(51) Int. Cl.

| | |
|---|---|
| ***F41A 9/31*** | (2006.01) |
| ***F41A 9/30*** | (2006.01) |
| ***F41A 9/36*** | (2006.01) |

(52) U.S. Cl.

CPC *F41A 9/31* (2013.01); *F41A 9/30* (2013.01); *F41A 9/36* (2013.01)

(58) Field of Classification Search

CPC ..... F41A 9/29; F41A 9/30; F41A 9/31; F41A 9/35

(Continued)

(56) References Cited

U.S. PATENT DOCUMENTS 698,472 A * 4/1902 Driggs ..... F41A 3/60 89/1.41

2,428,414 A 10/1947 Elliott (Continued)

FOREIGN PATENT DOCUMENTS

| | | | |
|---|---|---|---|
| EP | 0051 119 B1 | | 8/1981 |
| EP | 0 313 793 A2 | * | 5/1989 |
| GB | 696353 | * | 8/1953 |

*Primary Examiner* — Stephen M Johnson

(74) *Attorney, Agent, or Firm* — Richard E. Oney; Tiffany & Bosco, P.A.

(57) ABSTRACT

An improved delinking feeder receives a belt of linked cartridges, separates cartridges from the belt, and feeds the separated cartridges to a minigun for firing. The delinking feeder includes a feeder sprocket with a plurality of slots extending outward to an open end at an outer edge of the feeder sprocket body. Each of the slots is disposed along a curve. The curve decelerates a cartridge disposed in the slot as the cartridge moves outwardly in the slot. A feeder shaft is adapted to hold the feeder sprocket and a stripper. The shaft includes a section having a plurality of exterior splines, and the feeder sprocket includes an axial hole having a plurality of interior splines configured to mate with the plurality of shaft exterior splines. The stripper sleeve includes an axial hole having a plurality of interior splines configured to mate with the plurality of shaft exterior splines.

15 Claims, 9 Drawing Sheets

(58) Field of Classification Search
USPC ..... 89/9, 12, 13.05, 33.16, 33.17, 33.25
See application file for complete search history.

(56) References Cited

U.S. PATENT DOCUMENTS

| | | | | | |
|---|---|---|---|---|---|
| 2,453,786 | A | | 11/1948 | Dixon | |
| 2,648,258 | A | | 8/1953 | Simpson | |
| 2,815,699 | A | * | 12/1957 | Davis | F41A 9/31 89/33.25 |
| 2,821,887 | A | | 2/1958 | Gross et al. | |
| 2,849,921 | A | | 9/1958 | Otto | |
| 2,935,914 | A | | 5/1960 | Darsie et al. | |
| 2,959,106 | A | | 11/1960 | O'Brien | |
| 2,970,521 | A | | 2/1961 | Bell et al. | |
| 2,998,758 | A | | 9/1961 | Ouellette | |
| 3,041,939 | A | | 7/1962 | Dardick | |
| 3,263,565 | A | | 8/1966 | Dragonetti et al. | |
| 3,333,506 | A | * | 8/1967 | Henshaw | F41A 9/30 223/76 |
| 3,380,343 | A | | 4/1968 | Chiabrandy et al. | |
| 3,611,871 | A | | 10/1971 | Kirpatrick et al. | |
| 3,688,637 | A | | 9/1972 | Tan | |
| 3,706,259 | A | | 12/1972 | Ashley et al. | |
| 3,741,069 | A | * | 6/1973 | Stewart | F41A 9/35 89/11 |
| 4,015,511 | A | | 4/1977 | Folsom et al. | |
| 4,223,589 | A | * | 9/1980 | Post | F41A 9/37 89/33.04 |
| 4,259,891 | A | | 4/1981 | Rosenzweig | |
| 4,342,253 | A | | 8/1982 | Kirkpatrick et al. | |
| 4,359,927 | A | | 11/1982 | Tassie | |
| 4,384,508 | A | | 5/1983 | Sullivan et al. | |
| 4,397,216 | A | * | 8/1983 | Tassie | F41A 9/31 89/33.04 |
| 4,481,862 | A | | 11/1984 | Wiethoff et al. | |
| 4,541,193 | A | | 9/1985 | Flippin | |
| 4,660,457 | A | | 4/1987 | Biihler et al. | |
| 4,700,608 | A | | 10/1987 | Pettinga et al. | |
| 4,712,466 | A | | 12/1987 | Ghisoni | |
| 4,885,975 | A | | 12/1989 | Bohler et al. | |
| 4,924,753 | A | | 5/1990 | Tassie et al. | |
| 6,443,044 | B1 | | 9/2002 | Dillon | |
| 2011/0185883 | A1 | * | 8/2011 | Garwood | F41A 9/00 89/12 |

* cited by examiner

MINIGUN WITH IMPROVED FEEDER SPROCKET AND SHAFT

RELATED APPLICATION AND PRIORITY CLAIM

This application claims the benefit of U.S. Provisional Application No. 61/830,551, filed Jun. 3, 2013, entitled "Minigun with Improved Feeder Sprocket;" and U.S. Provisional Application No. 61/830,568, filed Jun. 3, 2013, entitled "Minigun with Improved Feeder Shaft" which are incorporated herein in their entirety by this reference.

BACKGROUND

This invention relates generally to Gatling-type miniguns. More specifically, it relates to an improved feeding delinker assembly for an electrically powered minigun.

Gatling-type miniguns have been known for many years. The Gatling-type minigun is a multi-barreled machine gun with a high rate of fire (2,000 to 6,000 rounds per minute). It features Gatling-style rotating barrels with an external power source, such as an electric motor. One previous example of such a gun is described in U.S. Pat. No. 7,971,515 B2, entitled "Access Door for Feeder and Delinker of a Gatling Gun," which is incorporated herein by this reference. Long existing motivations in the design of Gatling-type miniguns have been to minimize jams, extend the operational life and improve ease of use of such guns.

Gatling-type miniguns include a delinking feeder assembly, which is an ammunition feed device that receives an ammunition belt of linked cartridges, sequentially separates or "delinks" the cartridges from the ammunition belt, and feeds the cartridges to the minigun for firing. It is a principal object of the present invention to provide an improved delinking feeder for such a minigun.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided an improved delinking feeder for receiving a belt of linked cartridges, separating cartridges from the belt, and feeding the separated cartridges to a minigun for firing. The delinking feeder includes an improved feeder sprocket for receiving and feeding the cartridges to a minigun for firing. The feeder sprocket includes a sprocket body having an axial hole adapted for mounting the sprocket body to a rotatable shaft. The sprocket body includes a plurality of slots. Each of the slots includes an inner end for receiving a cartridge and extends outward to an open end at an outer edge of the feeder sprocket body. Each of the plurality of slots is disposed along a curve. The curve is configured to decelerate a cartridge disposed in the slot as the cartridge moves outwardly in the slot. In one advantageous embodiment, the curve is an involute curve.

According to another aspect of the invention, an improved delinking feeder includes a shaft adapted to hold a stripper sleeve and a feeder sprocket. The shaft includes a section having a plurality of exterior splines and the feeder sprocket includes an axial hole having a plurality of interior splines configured to mate with the plurality of shaft exterior splines.

According to still another aspect of the invention the shaft of the delinking feeder includes a section having a plurality of exterior splines and the stripper sleeve includes an axial hole having a plurality of interior splines configured to mate with the plurality of shaft exterior splines.

BRIEF DESCRIPTION OF THE DRAWINGS

The accompanying drawings and appendices, which are incorporated in and constitute a part of the specification, illustrate the presently preferred embodiments of the invention and, together with the general description given above and the detailed description of the preferred methods and embodiments given below, serve to explain the principles of the invention.

DESCRIPTION

Figure 1A:
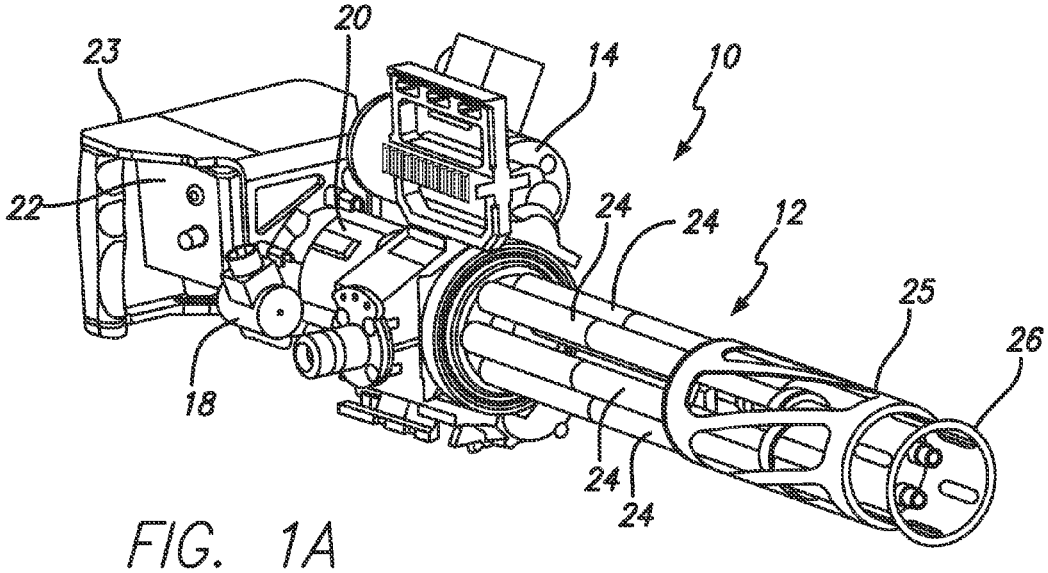
FIG. 1A is a top perspective view showing a side of an embodiment of an electrically-powered minigun according to the present invention.
Figure 1B:
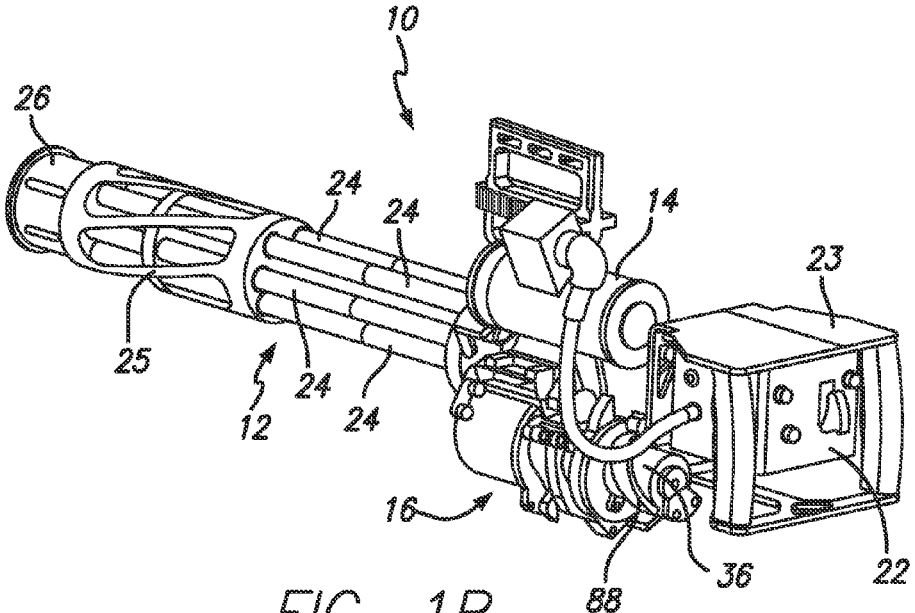
FIG. 1B is a top perspective view showing the other side of the minigun of FIG. 1A.

Referring to FIGS. 1A and 1B, a 7.62×51 mm minigun 10 for use with the present invention includes a barrel assembly 12, an electric drive motor 14 to rotate the barrel assembly 12, a delinking feeder 16, a clutch assembly 18, a gun housing assembly 20, a gun control unit 22, and a spade grip 23. The barrel assembly 12 includes a barrel clamp assembly 25, a plurality of barrels 24 circumferentially mounted to the barrel clamp assembly 25, and a flash suppressor 26. Ammunition is fired sequentially through the barrels 24 in a known fashion, i.e., first one barrel is used, then the next, then the next, etc. An electric cable 28 supplies power from the gun control unit 22 to the drive motor 14. The delinking feeder 16, which is an ammunition feed device, is engaged and disengaged via the electric cable 28. To provide access to the interior of the delinking feeder 16, an access door assembly 30 is mounted on the delinking feeder 16. The access door assembly 30 includes an access door 32 that is movable between a first closed operative position and a second open position to facilitate the loading of an ammunition belt 101 of linked cartridges 80. A portion of such an ammunition belt is depicted in FIG. 2.

As is well known to those of skill in the art, in the operation of the minigun 10, the drive motor 14 causes the barrel assembly 12 to rotate, and each barrel 24 fires sequentially in rapid succession. During such operation, the delinking feeder 16 receives the ammunition belt 101 of linked cartridges 80 (See FIG. 2), sequentially separates or "delinks" the cartridges 80 from the ammunition belt 101 and feeds the cartridges 80 to the minigun firing mechanism (not shown).

Still referring to FIGS. 1A and 1B, when an arming switch on the gun control unit 22 is activated, and one or both firing buttons are then depressed, the gun will fire. When the firing buttons are released, the delinking feeder 16 is disengaged so the ammunition supply is discontinued. The electric drive motor 14 continues to rotate for about 200 to 400 milliseconds so that the weapon is cleared of remaining ammunition before stopping. A booster motor override control button on the gun control unit 22, when depressed, activates an ammunition booster motor on the ammunition magazine (not shown) to facilitate the loading of the weapon. The booster motor pushes the belted ammunition from the ammunition magazine, through the feed chute, and to the weapon where it is inserted in the delinking feeder 16, readying the weapon for firing.

Figure 2:
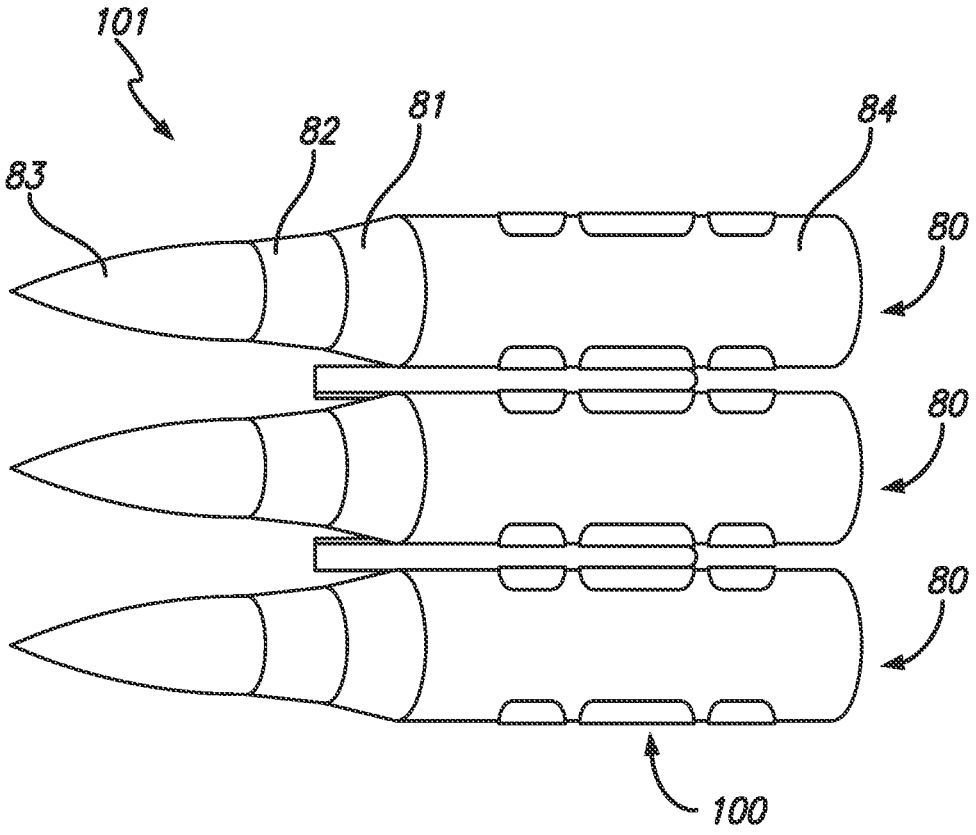
FIG. 2 PRIOR ART
FIG. 2 is a perspective view showing an ammunition belt of the prior art.

Referring to FIG. 2, each of the cartridges 80 in the ammunition belt 101 includes a cylindrical hollow casing 84 comprising the rear portion of cartridge 80. A primary conical tapered shoulder 81 extends from casing 84 to a conical tapered neck 82. Neck 82 extends from shoulder 81 to bullet 83.

Figure 3:
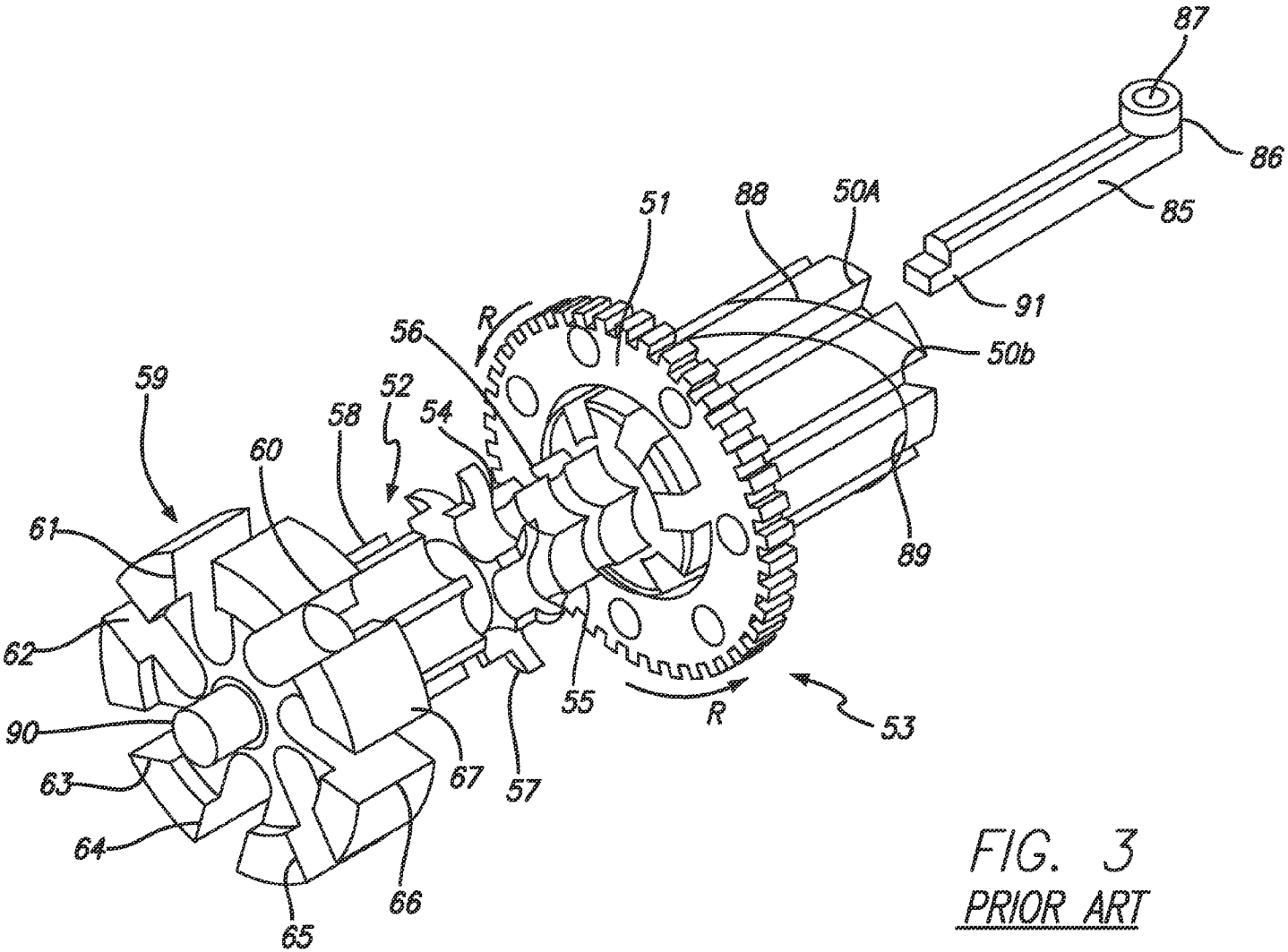
FIG. 3 PRIOR ART
FIG. 3 is a perspective view showing the interior of a prior art delinking feeder.

FIG. 3 illustrates internal components of a prior art delinking feeder 16. As shown in FIG. 3, a guide assembly 53 includes feeder shaft 90 that rotates (in a direction indicated by arrows R) on an axis that is parallel to the axis about which the barrel assembly 12 rotates. During operation, the guide assembly 53 continuously rotates to receive the ammunition belt 101, to remove cartridges 80 from the belt, and to feed the cartridges 80 for firing. Securely mounted to the feeder shaft 90 is a series of components, including a push rod guide 49, a toothed drive gear 51, sprockets 55, 56, a stripper sleeve 52 (including sprockets 54, 57 and 58), and a feeder sprocket 59. The drive motor 14 is rotationally coupled, via the drive gear 51, to the feeder shaft 90 and the push rod guide 49, sprockets 55, 56, stripper sleeve 52, and feeder sprocket 59. Each of the sprockets 54-58 has seven equally spaced grooves, with each groove having a generally semi-cylindrical shape for receiving a cartridge 80. Sprockets 55 and 56 comprise a cartridge holding construct for holding cartridges 80 that are linked to an ammunition belt 101 that has been inserted into the delinking feeder 16.

Still referring to FIG. 3, the guide assembly 53 includes a plurality of push rods 85, with one push rod 85 corresponding to each barrel 24 of the minigun 10. For example, in a minigun with a barrel assembly having six barrels 24, the guide assembly 53 has six push rods 85. The push rod guide 49 has a generally cylindrical body with longitudinal slots 50A uniformly distributed about its surface. Each of the push rods 85 can move longitudinally inside its associated longitudinal slot 50A. An arcuate outer surface 50B extends between each adjacent pair of slots 50A. Each groove in a sprocket 54 to 59 is aligned with one of the slots 50A. Each slot 50A slidably receives a push rod 85. Each push rod 85 has a wheel 86 rotatably secured to its rearward end by an axle 87 that extends outwardly from the outer face of the push rod 85. Each wheel 86 is confined within a spiral grooved channel, represented in FIG. 3 by the broken lines 88, which is incorporated into a feeder cam housing 36, as shown in FIG. 1B. As the push rod guide 49 is rotated about its axis by means of the drive motor 14, each of the push rods 85 is constrained by its respective drive wheel 86 to follow the path of the spiral channel 88, thereby slidably moving forward and backward in its associated longitudinal slot 50A with each rotation of the push rod guide 49. As a push rod 85 moves forward toward the drive gear 51, the push rod distal end 91 engages the rear of a cartridge 80 and pushes the cartridge 80 forward. As the cartridge 80 is driven forward, it is freed, or delinked, from the link 100 holding it (See FIG. 2) and is pushed toward and into the feeder sprocket 59 to be handed off to the minigun firing mechanism (not shown).

Still referring to FIG. 3, the stripper sleeve 52 (which includes sprockets 54, 57 and 58) is designed to receive and prevent longitudinal movement of a cartridge link 100 in the ammunition belt 101 so that a cartridge 80 can be pushed free of its associated link 100 by one of the push rods 85, i.e., the stripper sleeve 52 "holds" the cartridge link 100 while the cartridge 80 is pushed free by one of the push rods 85. The feeder sprocket 59 receives each cartridge 80 that is separated from the ammunition belt 101, and then hands off the cartridge 80 for firing.

Figure 4:
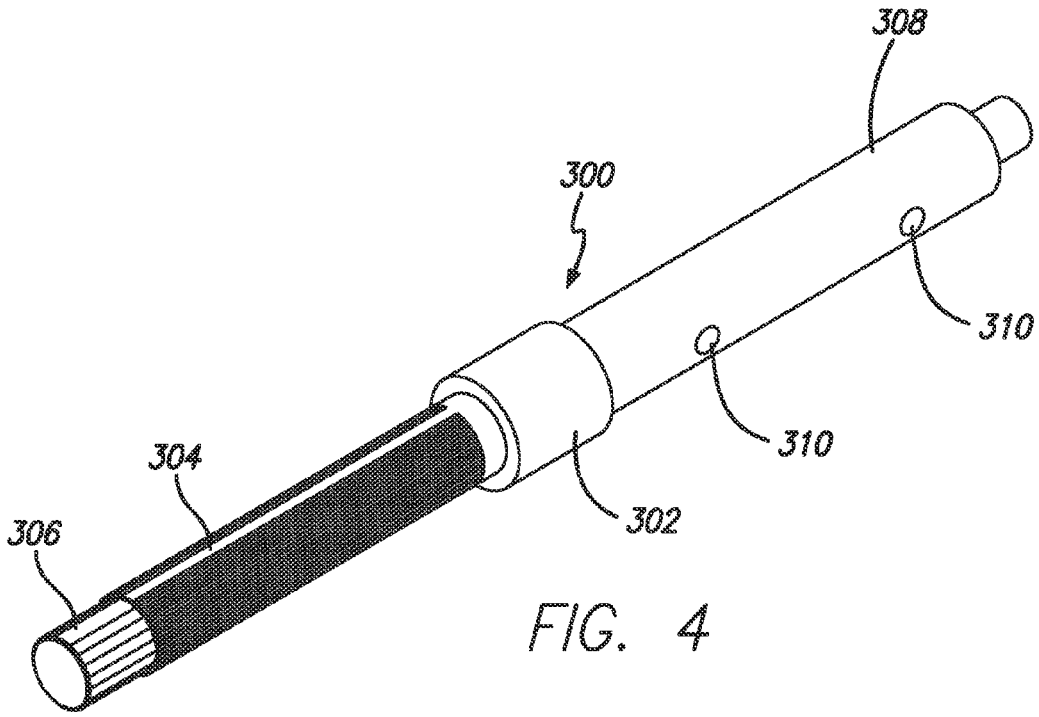
FIG. 4 is a perspective view of one embodiment of an improved feeder shaft according to the present invention
Figure 5:
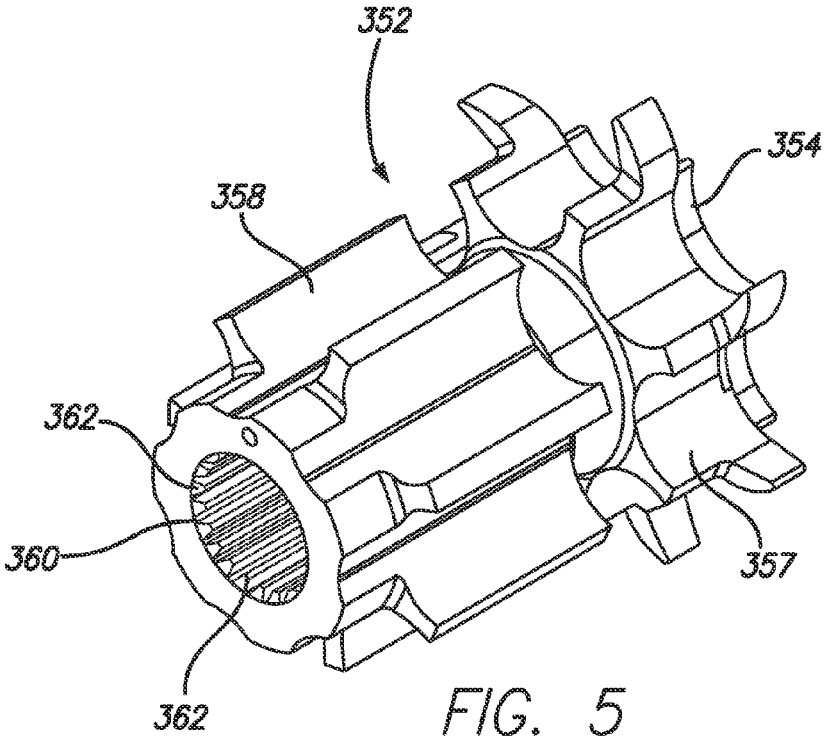
FIG. 5 is a perspective view of one embodiment of an improved stripper sleeve according to the present invention.

According to one aspect of the present invention, an improved delinking feeder 16 includes a feeder shaft 300 (as shown in FIG. 4) that holds an improved stripper sleeve 352 (as shown in FIG. 5) and an improved feeder sprocket 459 (as shown in FIGS. 7-12). As with the prior art feeder shaft 90 of FIG. 3, the improved feeder shaft 300 of FIG. 4 has a rear portion 308 for supporting the push rod guide 49 and the drive gear 51. Also as has been used in the prior art, the feeder shaft rear portion 308 includes through holes 310 for receiving pins (not shown) for mounting the push rod guide 49 and the drive gear 51 to the feeder shaft 300.

As shown in FIG. 4, and in contrast to previously known feeder shafts, the improved feeder shaft 300 includes a first splined portion 304 for holding the improved stripper sleeve 352 and a second splined portion 306 for holding the improved feeder sprocket 459. The first and second splined portions 304, 306 have exterior splines that mate with corresponding interior splines in axial holes 360, 410 on the improved stripper sleeve 352 and feeder sprocket 459, respectively. As will be understood by those in the art, in different embodiments, different numbers of spline teeth can be used. This configuration provides an improved coupling between the feeder shaft 300 and the stripper sleeve 352 and feeder sprocket 459, which provides better torque transmission to the stripper sleeve 352 and the feeder sprocket 459 over previously used coupling configurations. Moreover, use of the splined coupling enables quicker maintenance and improves reliability over that required for previously used pin coupling configurations. Registration of the feeder shaft 300 with the feeder components to be mounted to the shaft 300 can be achieved by providing one wider spline tooth on the component (or on the feeder shaft 300), with a corresponding space on the mating splined portion of the shaft 300 (or of the component). Examples of this can be seen in the interior splines 412 of the feeder sprocket embodiments shown in FIGS. 8 and 11.

Referring to FIG. 5, one embodiment of an improved stripper sleeve 352 according to the present invention is depicted. As with the prior art stripper sleeve 52 of FIG. 3, the improved stripper sleeve 352 includes sprockets 354, 357 and 358 (which correspond to sprockets 54, 57 and 58 of the prior art stripper sleeve 52). In contrast to previously used stripper sleeves, however, the improved stripper sleeve 352 includes an axial hole 360 with splines 362, which extend along at least a portion of the length of the axial hole 360 and are configured to mate with the corresponding exterior splines on the feeder shaft first splined portion 304, thereby providing the improved coupling between the stripper sleeve 352 and feeder shaft 300 previously described.

Figure 6:
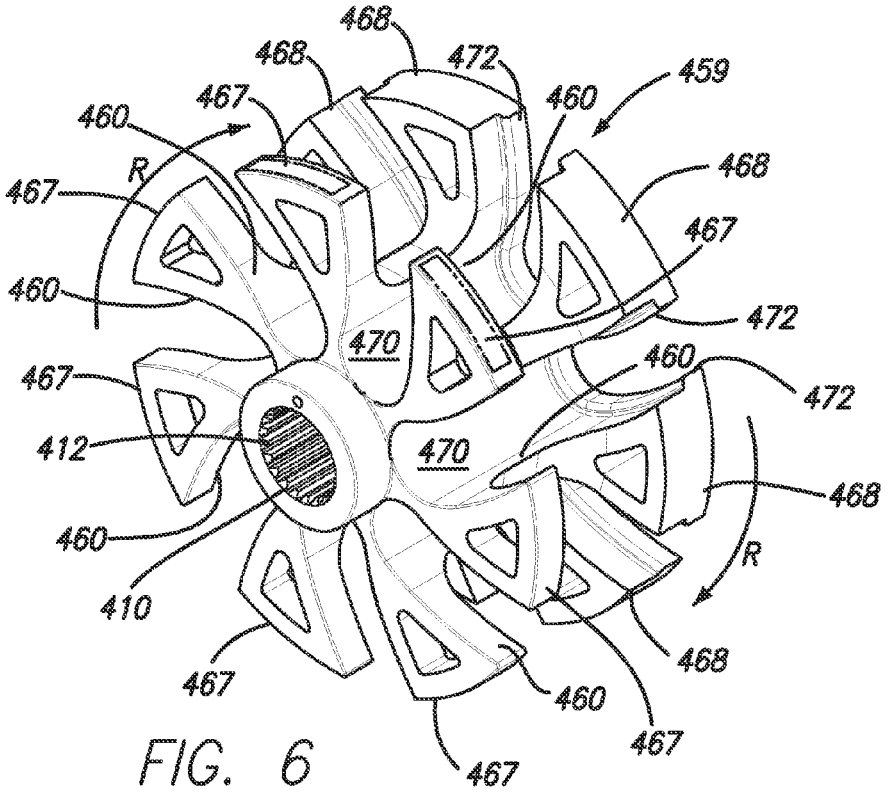
FIG. 6 is a rear perspective view of one embodiment of an improved feeder sprocket according to the present invention.
Figure 7:
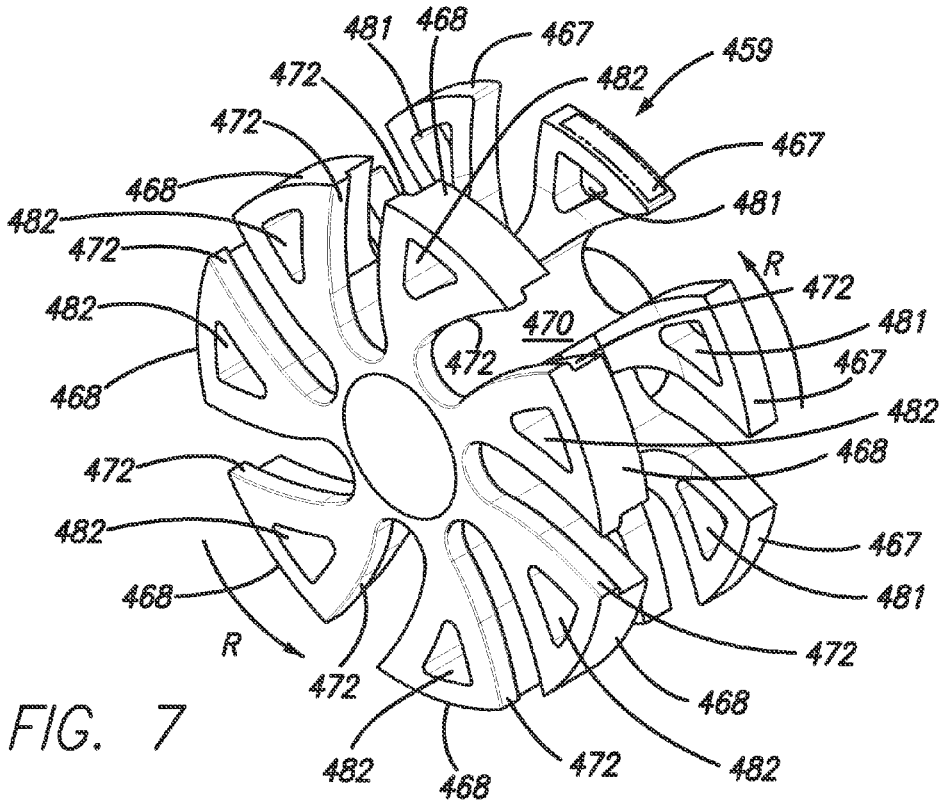
FIG. 7 is a front top perspective view of the improved feeder sprocket of FIG. 6.
Figure 8:
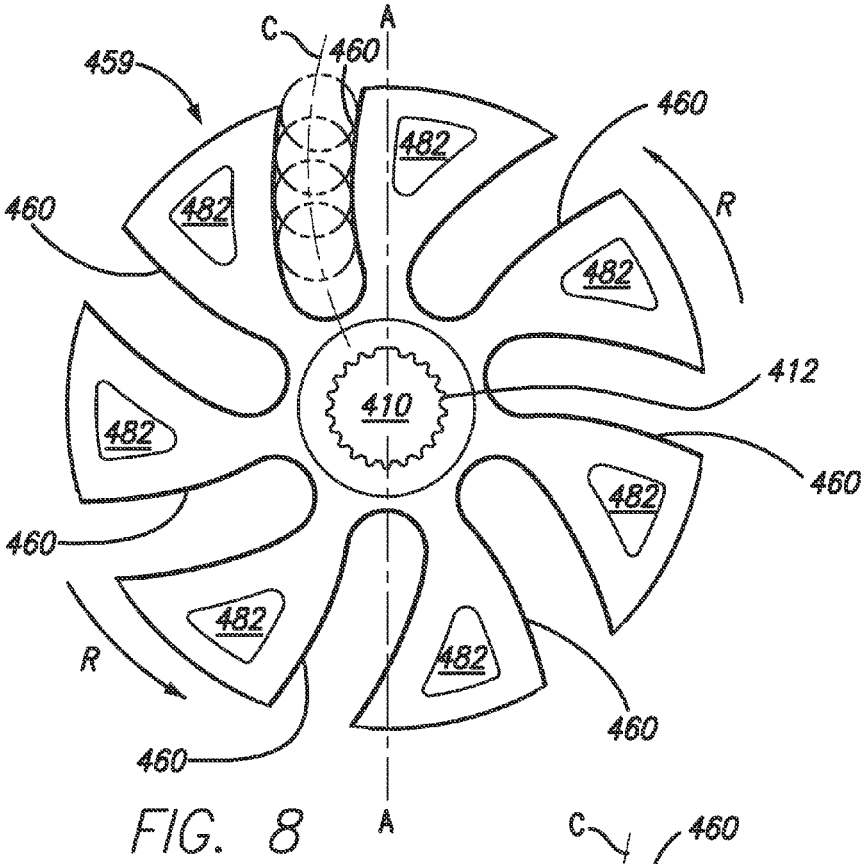
FIG. 8 is a front elevation view of the improved feeder sprocket of FIG. 6.
Figure 9:
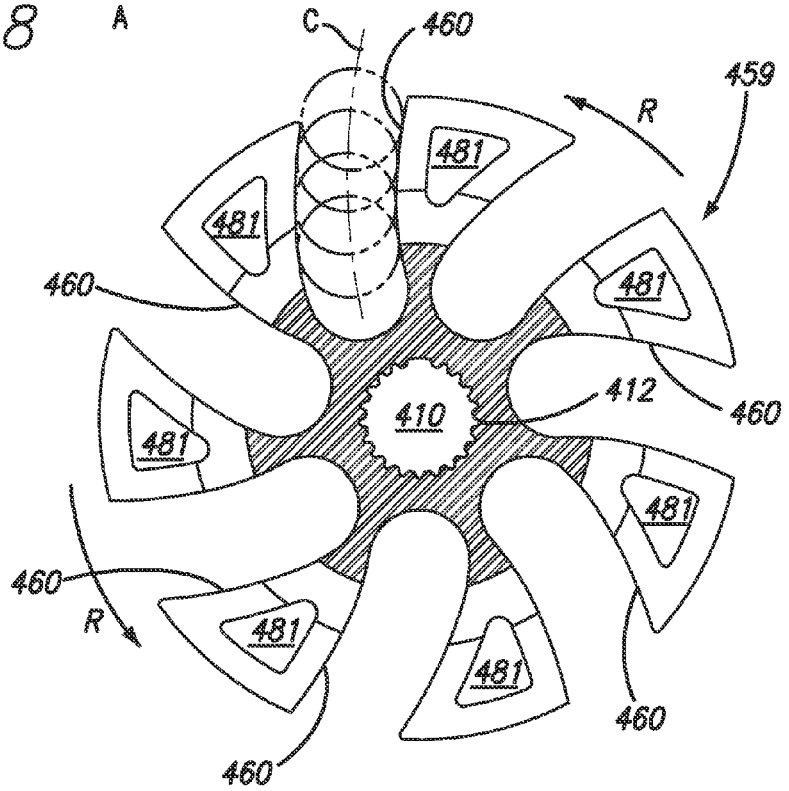
FIG. 9 is a cross-sectional front elevation view of the improved feeder sprocket of FIG. 6, taken through line B-B of FIG. 10.

Referring to FIGS. 6-10, one embodiment of an improved feeder sprocket 459 according to the present invention is depicted. Similar to prior art feeder sprocket 59, the improved feeder sprocket 459 includes seven equally spaced slots 460 for receiving cartridges 80 that are separated from the ammunition belt 101 and handing off those cartridge 80 for firing. Each of the slots 460 has a generally U-shaped inner end 470 for receiving a cartridge 80 that has been delinked from the ammunition belt 101 and pushed into the feeder sprocket 459. Each of the slots 460 is open at the outer edge of the feeder sprocket 459 to "handoff" the cartridge to the minigun firing mechanism (not shown) as the feeder sprocket 459 rotates. In contrast to the slots 60 in the prior art sprocket 59, which are disposed along a straight radial line from the feeder sprocket center to its outer edge (See FIG. 3) the slots 460 of the improved feeder sprocket 459 are disposed along a curve C as shown in FIGS. 8 and 9. In a preferred embodiment, each of the slots 460 includes a portion having opposing, substantially parallel sides disposed along a curve C, and the curve is in a direction opposing the direction of the shaft rotation (see FIGS. 8 and 9). In one embodiment, the curve C is an involute curve. Advantageously, using curved slots 460, rather than the straight slots 60 of prior art feeder sprockets, improves the handoff of the cartridge 80 by reducing friction between the feeder sprocket 459 and the cartridge 80 and by decelerating the cartridge as it moves outwardly in the slot 460, thereby more effectively controlling movement of a cartridge into and out of feeder sprocket 459 to provide a "gentler" handoff, increasing the operational life of the feeder sprocket 459 and reducing the likelihood that a cartridge 80 will jam while traveling out of the sprocket 459.

Figure 10:
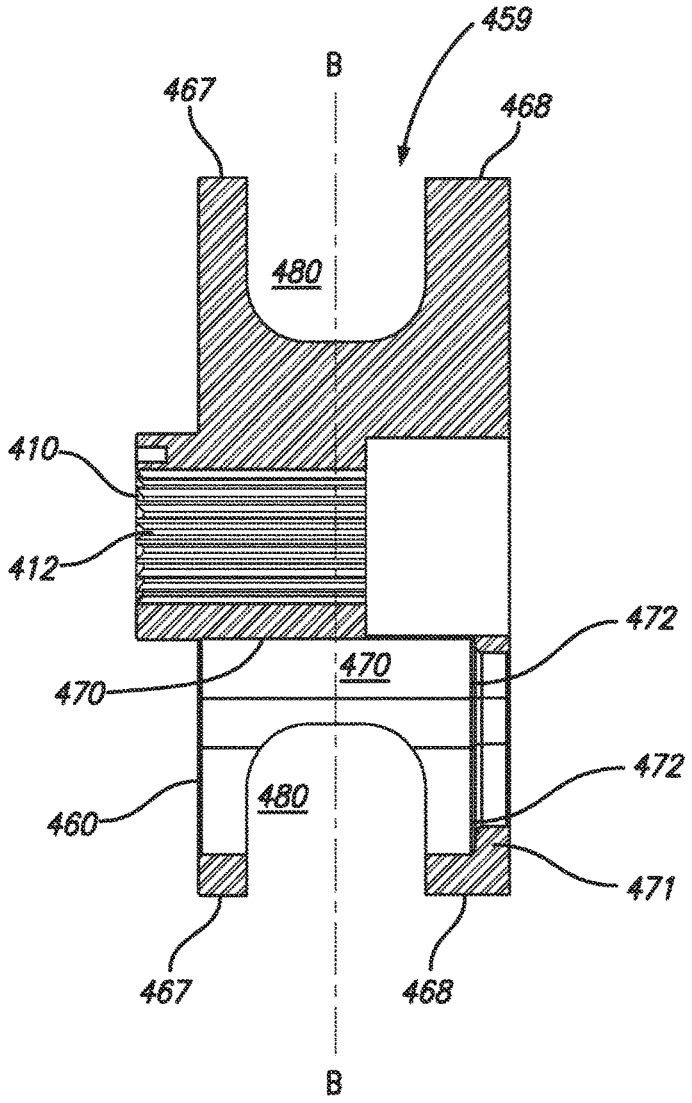
FIG. 10 is a cross-sectional side elevation view of the feeder sprocket of FIG. 6, taken through line A-A of FIG. 8.

Also in contrast to the previously known feeder sprocket 59, the outer portion of each of the slots 460 of the improved sprocket 459 is defined by a rear vein 467 and a front vein 468, which are separated by a void 480. In addition, each of the rear veins 467 has a void 481 (See FIG. 9), and each of the front veins 472 has a void 482 (See FIG. 8). Advantageously, by providing the voids 480, 481 and 482, the improved feeder sprocket 459 can be made lighter in weight than previously used sprockets. Each of the front veins 468 has a shoulder 472 for contacting the neck 82 of a cartridge 80 without contacting the bullet 83. As can be seen in FIGS. 6, 7 and 10, the shoulder 472 extends along the entire length of each side of each slot 460 and around the periphery of the U-shaped inner end 470 of the slot 460. When a cartridge 80 is fully inserted into the feeder sprocket 459, the shoulder 472 at the U-shaped inner end 470 will contact the cartridge neck 82 approximately half way around the periphery of the cartridge neck 82. In this position, the entire cartridge shoulder 81 (See FIG. 2) is disposed in the slot 460, with a rear portion of the cartridge neck 82 disposed inside the slot 460 and a front portion of neck 82 extending forward out the feeder sprocket 459 (See FIGS. 2 and 10). As the feeder sprocket 459 rotates in the direction shown by arrows R (See FIGS. 6-9) and the cartridge 80 exits the slot 460 to be fed to the firing mechanism, the cartridge neck 82 will contact and roll along sections the shoulder 472 and the cartridge casing 84 will inner walls of the slot 460.

Figure 11:
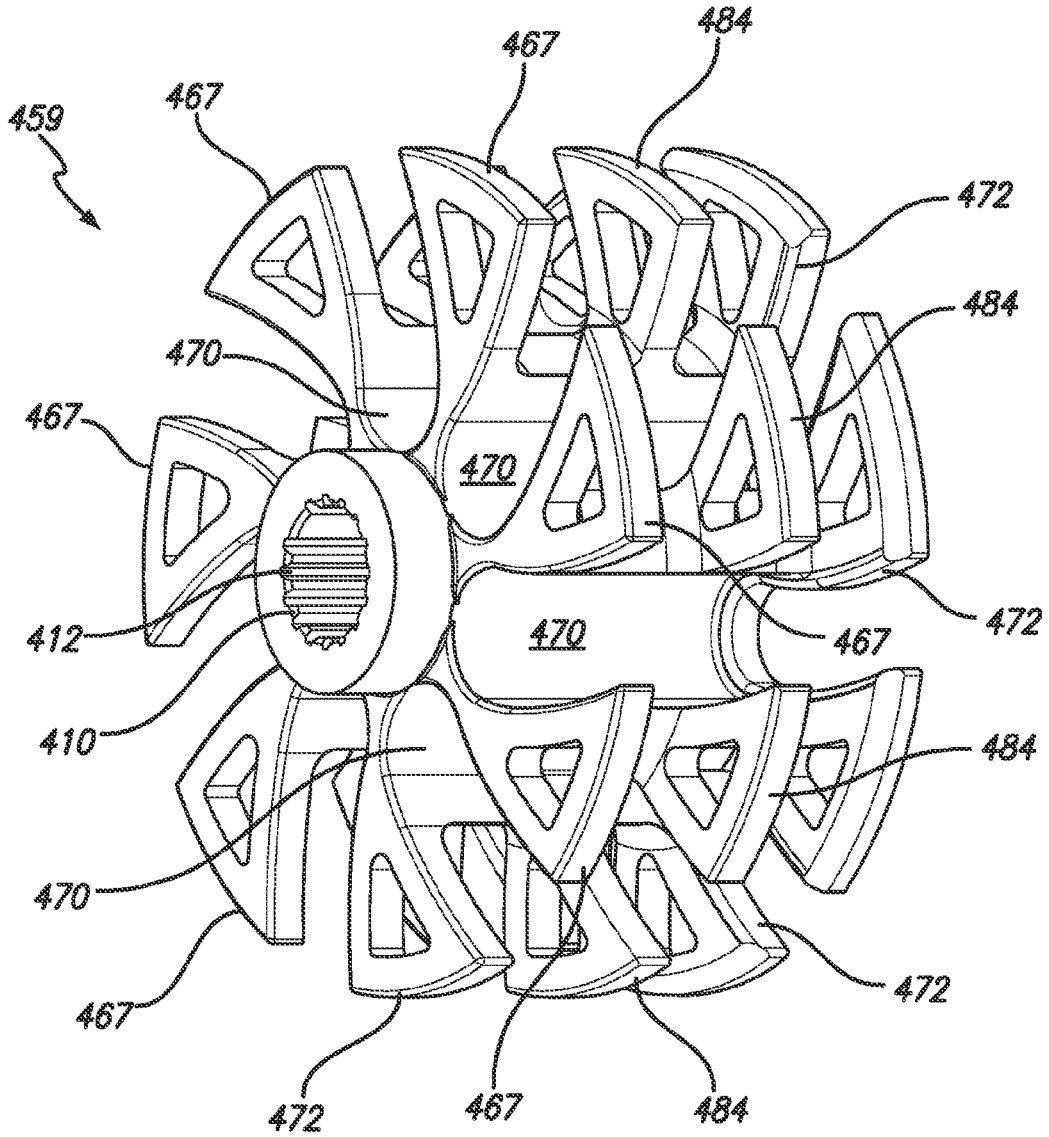
FIG. 11 is a rear perspective view of another embodiment of an improved feeder sprocket according to the present invention.
Figure 12:
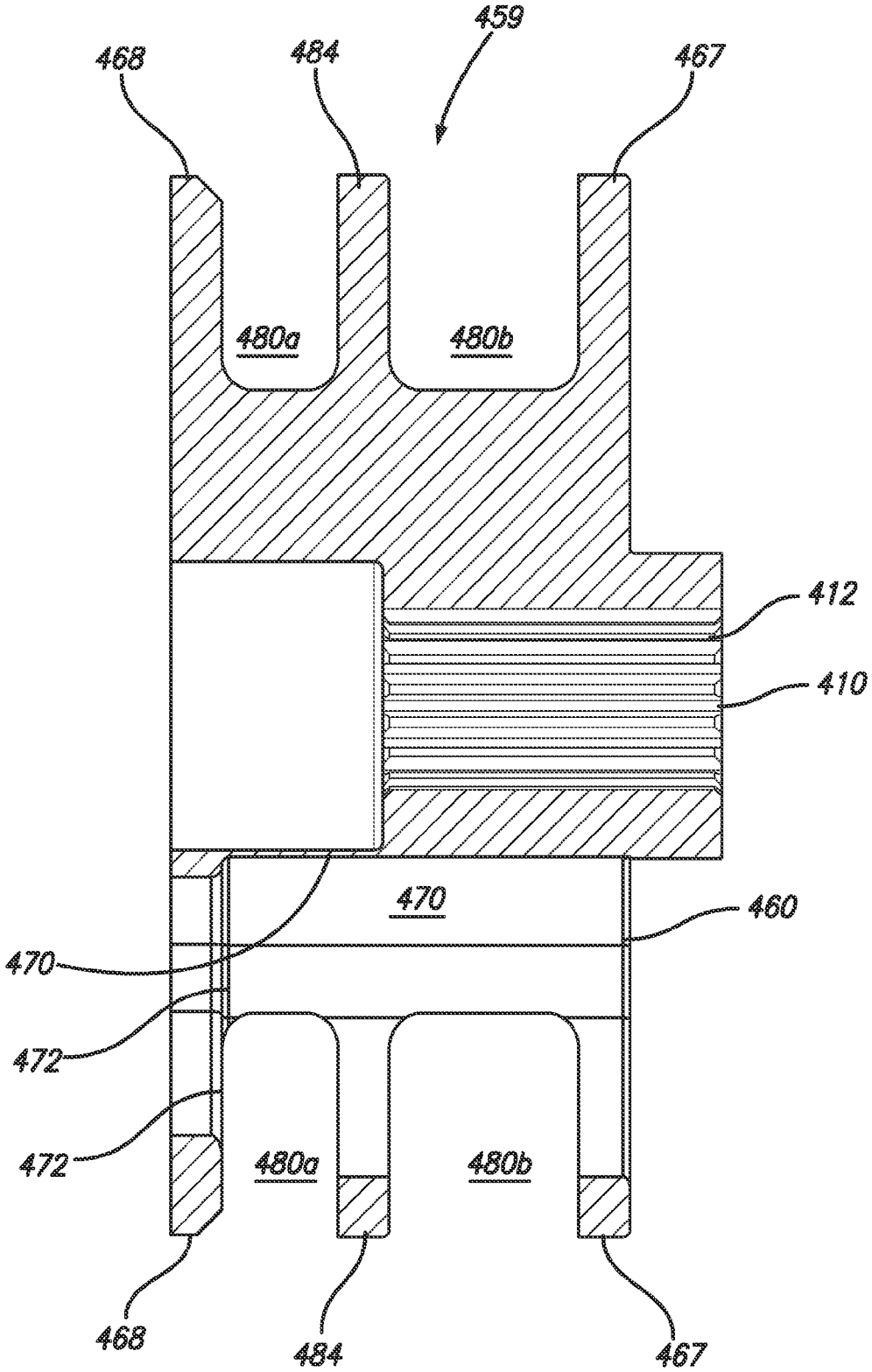
FIG. 12 is a cross-sectional side elevation view of the feeder sprocket of FIG. 11.

Referring to FIGS. 11 and 12, an alternative embodiment of an improved feeder sprocket 459 according to the present invention is depicted. In this embodiment, the feeder sprocket 459 includes an intermediate vein 484, in addition to the rear vein 467 and front vein 468, for defining each of the curved slots 460. The void 480 is divided into a front void **480*a* and a rear void 480*b*. The intermediate vein 484 provides additional support for the cartridge casing 84 as it moves in and out of the slot 460**.

Referring to FIGS. 6-12, also in contrast to previously used feeder sprockets, the improved feeder sprocket 459 includes an axial hole 410 with interior splines 412, which extend along at least a portion of the length of the axial hole 410 and are configured to mate with the corresponding external splines on the feeder shaft second splined portion 306, thereby providing the improved coupling between the feeder sprocket 459 and feeder shaft 300, as previously described.

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. An improved feeder sprocket for receiving and feeding cartridges to a firing mechanism of a multi-barrel machine gun for firing, the feeder sprocket comprising:

a feeder sprocket body adapted for mounting to a rotatable shaft;

wherein the feeder sprocket body includes a plurality of slots;

wherein each of the plurality of slots includes an inner end for receiving a cartridge and extends outward to an open end at an outer edge of the feeder sprocket body; and wherein each of the plurality of slots includes a curved portion having opposing, substantially parallel sides that are curved along at least a portion of the length of the slot;

wherein the shaft is configured to rotate in a direction of rotation during firing of the machine gun; and wherein the curved portion of each of the plurality of slots curves in a direction opposing the direction of rotation.

2. The improved feeder sprocket of claim 1 wherein the curved portion of each of the plurality of slots comprises an involute.

3. The improved feeder sprocket of claim 1 wherein each of the plurality of slots is configured to decelerate a cartridge disposed in the slot as the sprocket rotates and the cartridge moves outwardly in the slot.

4. The improved feeder sprocket of claim 1 wherein the feeder_ sprocket body includes an axial hole adapted for receiving the rotatable shaft and the axial hole includes an interior surface configured to mate with one or more teeth or grooves on the rotatable shaft.

5. The improved feeder sprocket of claim 1 wherein at least one of the plurality of slots includes a shoulder on each side of the slot for contacting a neck portion of a cartridge positioned in the slot and wherein the shoulder extends along at least a portion of a length of the slot between the slot inner end and the slot outer edge.

6. An improved delinking feeder for receiving a belt of linked cartridges, separating the cartridges from the belt, and feeding the separated cartridges to a firing mechanism of a multi-barrel machine gun for firing, the delinking feeder comprising:

a stripper sleeve and a feeder sprocket mounted to a rotatable shaft;

wherein the feeder sprocket includes:

a body having an axial hole adapted for mounting the feeder sprocket to the rotatable shaft; and a plurality of slots wherein each of the plurality of slots includes an inner end configured to receive a cartridge and extends outwardly along a length from the inner end to an open end at an outer edge of the feeder sprocket body;

wherein each of the plurality of slots includes a curved portion having opposing, substantially parallel sides that are curved along at least a portion of the slot length; and wherein the shaft is configured to rotate in a direction of rotation during firing and the curved portion of each of the plurality of slots curves in a direction opposing the direction of rotation.

7. The improved delinking feeder of claim 6 wherein each of the plurality of slots is configured to decelerate a cartridge disposed in the slot as the sprocket rotates and the cartridge moves outwardly in the slot.

8. The delinking feeder of claim 6 wherein the slot curved portion comprises an involute.

9. A Gatling-type multi-barrel machine gun comprising:

a barrel assembly including a plurality of circumferentially mounted gun barrels;

a motor adapted to rotate the barrel assembly; and a delinking feeder for receiving a belt of linked cartridges, separating the linked cartridges from the belt, and feeding the separated cartridges to a firing mechanism;

wherein the delinking feeder includes a rotatable shaft coupled to the motor and adapted to hold a stripper sleeve and a feeder sprocket;

wherein the feeder sprocket includes a body adapted for mounting to the rotatable shaft and having a plurality of curved slots;

wherein each of the plurality of curved slots includes an inner end for receiving a cartridge and extends outwardly along a slot length from the inner end to an open end at an outer edge of the feeder sprocket body;

wherein each of the plurality of slots includes a portion having opposing, substantially parallel sides disposed along a curve; and wherein the shaft rotates in a direction of rotation during firing of the machine gun and the curve of each of the plurality of slots is in a direction opposing the direction of rotation.

10. The Gatling-type multi-barrel machine gun of claim 9 wherein the curve of each of the plurality of slots comprises an involute.

11. The Gatling-type multi-barrel machine gun of claim 9 wherein each of the plurality of slots is configured to decelerate a cartridge disposed in the slot as the sprocket rotates and the cartridge moves outwardly in the slot.

12. The Gatling-type multi-barrel machine gun of claim 9 wherein the feeder sprocket includes an axial hole adapted to receive the rotatable shaft and the axial hole includes an interior surface configured to mate with one or more teeth or grooves on the rotatable shaft.

13. The Gatling-type multi-barrel machine gun of claim 9 wherein at least one of the plurality of feeder sprocket slots includes a shoulder on each side of the slot for contacting a neck portion of a cartridge positioned in the slot and wherein the shoulder extends along at least a portion of the slot length.

14. The Gatling-type multi-barrel machine gun of claim 9 wherein the delinking feeder shaft includes one or more teeth or grooves and the feeder sprocket includes an axial hole configured to receive the shaft, and wherein the axial hole has an interior surface configured to mate with the one or more shaft teeth or grooves.

15. The Gatling-type multi-barrel machine gun of claim 9 wherein the delinking feeder shaft includes one or more teeth or grooves and the stripper sleeve includes an axial hole configured to receive the shaft, and wherein the axial hole has an interior surface configured to mate with the one or more shaft teeth or grooves.

* * * * *